United States Patent [19]

Iwasaki et al.

[11] Patent Number: 4,978,398

[45] Date of Patent: Dec. 18, 1990

[54] MAGNETICALLY ANISOTROPIC HOT-WORKED MAGNET AND METHOD OF PRODUCING SAME

[75] Inventors: Katsunori Iwasaki, Kumagaya; Shigeho Tanigawa, Kounosu; Masaaki Tokunaga, Fukaya, all of Japan

[73] Assignee: Hitachi Metals, Ltd., Tokyo, Japan

[21] Appl. No.: 327,631

[22] Filed: Mar. 23, 1989

[30] Foreign Application Priority Data

Sep. 30, 1988 [JP] Japan ..... 63-247172

[51] Int. Cl.[5] ..... H01F 1/08

[52] U.S. Cl. ..... 148/101; 148/104; 419/11; 419/12; 419/14; 419/35

[58] Field of Search ..... 148/101, 104; 419/11, 419/12, 14, 35

[56] References Cited

U.S. PATENT DOCUMENTS 4,780,226 10/1988 Sheets et al. ..... 252/28

FOREIGN PATENT DOCUMENTS 0126179 of 0000 European Pat. Off. .
0133758 3/1985 European Pat. Off. .
0195219 9/1986 European Pat. Off. .
62-34101 of 0000 Japan .
63-98105 of 0000 Japan .
61-119006 of 0000 Japan .
61-208809 of 0000 Japan .
60-184602 9/1985 Japan ..... 148/101
60-184604 9/1985 Japan ..... 148/101
62-206801 9/1987 Japan ..... 148/104
62-254408 11/1987 Japan ..... 148/104

*Primary Examiner*—John P. Sheehan
*Attorney, Agent, or Firm*—Finnegan, Henderson, Farabow, Garrett & Dunner

[57] ABSTRACT

A magnetically anisotropic hot-worked magnet made of an R-T-B alloy containing a transition metal T as a main component, a rare earth element R including yttrium, and boron B; the magnet having fine crystal grains having an average grain size of 0.02–1.0 μm, and having a carbon content of 0.8 weight % or less than an oxygen content of 0.5 weight % or less. The angular variance of orientation of the crystal grains is within 30° from the C axes of the crystal grains when measured by X-ray. This magnet can be produced by mixing the magnet flakes with an additive composed of at least one organic compound having a boiling point of 50° C. or higher.

9 Claims, 7 Drawing Sheets

200μm

10μm

MAGNETICALLY ANISOTROPIC HOT-WORKED MAGNET AND METHOD OF PRODUCING SAME

BACKGROUND OF THE INVENTION

The present invention relates to hot-worked permanent magnets consisting substantially of rare earth elements, transition metals and boron and provided with magnetic anisotropy by hot working, and more particularly to hot-worked magnets having improved crystal grain orientation and thus having good magnetic properties. It also relates to a method of producing such hot-worked magnets without cracking by adding proper amounts of additives to improve their workability.

Permanent magnets consisting essentially of rare earth elements, transition metals and boron (hereinafter referred to as "R-T-B permanent magnets") have been getting much attention as inexpensive permanent magnets having excellent magnetic properties. This is because intermetallic compounds expressed by $R_2T_{14}B$ having a tetragonal crystal structure have excellent magnetic properties. $Nd_2Fe_{14}B$, in which Nd is employed as R, has lattice parameters of $a_0=0$ 878 nm and $C_0=1.218$ nm.

The R-T-B permanent magnets are usually classified into two groups: sintered magnets and rapidly quenched magnets. Whichever production method is utilized, it is necessary to form them to desired shapes. In this sense, they should have good workability. In order to improve the workability of the magnets, the addition of lubricating agents has conventionally been conducted. The lubricants are classified into external lubricants which are applied to die surfaces or surfaces of magnet products to be formed to reduce a friction coefficient between the die surfaces and the magnet products being formed, and internal lubricants which are in the form of powder, liquid, solid, etc. and added to the magnet products to be formed to reduce a friction coefficient between powder particles.

In the case of sintered magnets, stearic acid is widely used as an internal lubricant (Japanese Patent Laid-Open No. 61-34101). Here, stearic acid is a saturated aliphatic acid having the formula: $CH_3(CH_2)_{16}COOH$.

Incidentally, it is known to suppress the growth of crystal grains and simultaneously increase the density of the resulting magnet in the sintering step by adding carbon powder or powder of carbide-forming components such as Ti, Zr, Hf, etc. to form metal carbides [Japanese Patent Laid-Open No. 63-98105).

However, if sintered magnets are to be provided with magnetic anisotropy, a pressing step in a magnetic field would have to be conducted, limiting the shapes of magnets to be formed.

In view of this fact, much attention has come to be paid to rapidly quenched magnets which do not need the pressing in a magnetic field, particularly permanent magnets obtained by pulverizing thin ribbons or flakes produced from melts of R-T-B alloys by a rapid quenching method, hot-pressing them (high-temperature treatment) and then subjecting them to plastic working at high temperature to provide them with magnetic anisotropy, which will be called "hot-worked magnets" hereinafter) (European Patent Laid-Open No. EP 0,133,758). The thin ribbons or flakes produced by a rapid quenching method usually contain innumerable fine crystal grains. Even though the thin ribbons or flakes produced by a rapid quenching method are in various planar shapes of 30 μm in thickness and 500 μm or less in length, the crystal grains contained therein are as fine as 0.02–1.0 μm in an average grain size, which is smaller than the average grain size of 1–90 μm in the case of sintered magnets (for instance, European Patent Laid-Open No. EP 0,126,179). The average grain size of the rapidly quenched magnets is close to 0.3 μm, the critical size of a single domain of the R-T-B magnet, which means that it provides essentially excellent magnetic properties.

In the case of hot working of the rapidly quenched magnetic materials, it is important that there is a close relationship between the direction of their plastic flow and their magnetic orientation perpendicular to the direction of the plastic flow. Further, it is necessary to cause the plastic flow uniformly in the entire magnet to be worked, in order to improve the orientation of the crystal grains having close relations with magnetic properties. Incidentally, a nonuniform deformation may cause bulging of the magnets in the plastic working process, which in turn produces large or many cracks in the peripheral portions of the magnets. This is a serious problem when hot-worked magnets are to be obtained in the shape of final products.

Most of force applied in a hot-working process is used for plastic deformation, but part of the force is exhausted by friction. This may be partially the cause of the above bulging phenomenon.

European Patent Laid-Open No. EP 0,133,758 discloses the coating of a die surface with graphite as an external lubricant for hot die-upsetting, to improve the workability of magnets in the hot-working process, thereby obtaining hot-worked magnets free from cracks. Incidentally, the effects of graphite on the inner lubrication of the magnets are not referred to.

In the above-mentioned conventional techniques, graphite applied to the die surface for die lubrication is only partly, if any, attached to thin ribbons or flakes produced by a rapid quenching method, which are 30 μm or so in thickness and 500 μm or less in length, much less to innumerable fine crystal grains inside the thin flakes.

Incidentally, in the case of adding carbon powder or powder of carbide-forming components such as Ti, Zr, Hf, etc. to sintered magnets, it is expected that such powder is relatively easily dispersed in magnet powder by appropriately selecting a powder shape and a mixing method. The same is true of stearate. This is because in the case of sintered magnets, magnetic powder particles produced by pulverizing alloy ingots are in a shape close to sphere.

However, unlike the sintered magnets produced by a powder metallurgy method in which compacting is conducted at room temperature, in the case of hot-working such as die-upsetting, it is usually conducted at as high a temperature as 600°–850° C. Accordingly, additives dispersed among thin flakes show essentially different functions, and this has not yet been paid any attention so far.

In addition, in the conventional techniques in which an external lubricant is applied to a die surface, they do not show effects peculiar to the hot working of the magnets, but they simply show effects of lubricants which slightly decrease a friction coefficient between the die surface and materials being worked. In fact, there has been no report so far with respect to the improvement of workability without remarkable cracking and the improvement of uniform orientation in the field of hot-working of rapidly quenched magnet ribbons or flakes.

OBJECT AND SUMMARY OF THE INVENTION

Accordingly, an object of the present invention is to provide a hot-worked magnet made of an R-T-B alloy free from cracks and with high magnetic anisotropy because of uniform crystal grain orientation.

Another object of the present invention is to provide a method of producing such a hot-worked magnet.

The magnetically anisotropic hot-worked magnet according to the present invention is made of an R-T-B alloy containing a transition metal T as a main component, a rare earth element R including yttrium and boron B; the magnet having fine crystal grains having an average grain size of 0.02–1.0 μm, and having a carbon content of 0.8 weight % or less and an oxygen content of 0.5 weight % or less.

The method of producing a magnetically anisotropic hot-worked magnet according to the present invention comprises rapidly quenching a melt of an R-T-B alloy containing a transition metal T as a main component, a rare earth element R including yttrium and boron B to form thin ribbons or flakes, pulverizing the thin ribbons or flakes to form magnetic powder, and subjecting the magnet powder to hot working to provide the resulting magnet with magnetic anisotropy, characterized in that the magnetic powder is mixed with an additive composed of at least one organic compound having a boiling point of 50° C. or higher.

BRIEF DESCRIPTION OF THE DRAWINGS

FIG. 5 B is a photomicrograph (magnification: 100) of a hot-worked magnet produced with no additive, which is taken in perpendicular to the compression direction of the hot-worked magnet:

FIG. 5 C is an electron micrograph (magnification: 2000) of a hot-worked magnet produced with no additive, which is taken in perpendicular to the compression direction of the hot-worked magnet;

FIG. 6 B is an electron micrograph (magnification: 2000) of a hot-worked magnet produced by using 0.1 weight % of oleic acid, which is taken in perpendicular to the compression direction of the hot-worked magnet;

FIG. 7 B is an electron micrograph (magnification: 2000) of a hot-worked magnet produced by using 0.3 weight % of oleic acid, which is taken in perpendicular to the compression direction of the hot-worked magnet;

FIG. 8 B is an electron micrograph (magnification: 2000) of a hot-worked magnet produced by using 0.5 weight % of oleic acid, which is taken in perpendicular to the compression direction of the hot-worked magnet;

DETAILED DESCRIPTION OF THE INVENTION

Figure 1:
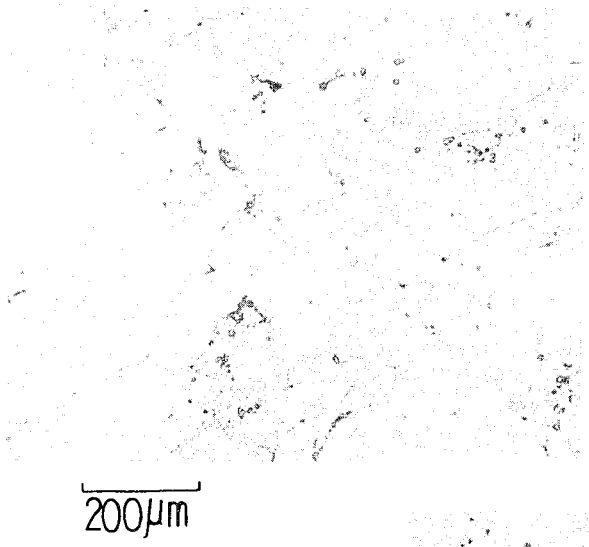
FIG. 1 is a photomicrograph (magnification: 100) of a hot-worked magnet produced by using 0.5 weight % of diethylene glycol, which is taken in parallel with the compression direction of the hot-worked magnet.

It has conventionally been believed that the addition of additives exerts adverse effects on magnetic properties of the hot-worked magnets because they tend to leave carbon and oxygen in the magnets after hot working.

However, the inventors have tried, without being restricted by the common sense in the field of hot-worked magnets, to improve the workability and magnetic properties of the hot-worked magnets by adding proper amounts of particular organic compounds, instead of adding carbon or oxygen as a single material. As a result, it has been surprisingly found that the additives including organic compounds such as alcohols, carboxylic acids, esters, oxo compounds, ethers and their derivatives, which have boiling points of 50° C. or higher, are effective for improving the workability and magnetic properties of the hot-worked magnets. The above compounds may be added alone or in combination.

The boiling points of the additives should be 50° C. or higher, because if otherwise, they are evaporated in the early stage of temperature elevation in the process of hot working, thus providing substantially no effects. The additives preferably have boiling points of 150° C. or higher.

Preferred examples of the alcohol compounds include aliphatic monovalent alcohols such as butyl alcohol, amyl alcohol, hexyl alcohol, octyl alcohol, propyl alcohol, etc.; and multivalent alcohols such as ethylene glycol, diethylene glycol, triethylene glycol, propylene glycol, trimethylene glycol, tetramethylene glycol, glycerin, diglycerin, triglycerin, etc.

Preferred examples of the carboxylic acids include propionic acid, lauric acid, stearic acid, palmitic acid, acrylic acid, oleic acid, linoleic acid, benzoic acid, oxalic acid, etc.

Further, various oxo compounds (ketones, ketenes, aldehydes, etc.), esters and ethers, which have boiling points of 50° C. or higher, are also suitable as additives of the present invention. Their examples include methyl ethyl ketone, methyl propyl ketone, cyclopentanone, benzophenone, diphenylketene, diethylketene, acrolein, propionaldehyde, caprylaldehyde, propyl ether, methyl amyl ether, allyl ether, phenyl ether, etc.

In the present invention, (1) the additives act to suppress the growth of crystal grains between the fine flaky particles in the magnets being hot-pressed.

(2) Nd components oozing from the fine flaky particles are reacted with C and O derived from the additives, thereby changing the properties of the boundaries.

(3) Because of the actions (1) and (2), a proper amount of the additive serves to improve the workability of the magnets, thereby providing them with high orientation. This is one reason for improving the residual magnetic flux densities of the magnets.

(4) Since excess Nd is removed from the main phases by the reaction (2), the amount of Nd becomes proper in the entire magnets, which also serves to improve the residual magnetic flux densities.

When the organic compounds having boiling points lower than 50° C. are used as additives, they are evaporated during mixing or in the early stage of temperature elevation, thereby providing substantially no effects.

The hot working of the magnets according to the present invention is conducted preferably at a temperature of about 600°–850° C. When the hot-working temperature is lower than 600° C., Nd-rich phases necessary for plastic deformation are not easily formed regardless of the addition of the additives. As a result, the resulting hot-worked magnets suffer from many cracks. By increasing the amount of additives, the hot-working temperature shifts toward a higher temperature, and the hot working can be conducted at a temperature up to 850° C. without severely deteriorating the magnetic properties of the resulting magnets. When the hot-working temperature exceeds 850° C., the crystal grains become coarse, leading to deterioration of the magnetic properties and also generating many cracks. The more preferred hot-working temperature is about 700°–820° C.

The organic compounds used as additives in the present invention are mainly composed of hydrocarbons, and the dissociation of the molecular chains starts about 250° C. Accordingly, in the hot working at about 600°–850° C., hydrocarbon bonds are cut to separate hydrogen atoms as molecular hydrogen $H_2$. In this case, carbon atoms or oxygen atoms from which hydrogen atoms leave become radicals and are active enough to easily react with the surface of R-T-B magnetic powder particles. It is considered that this causes extreme effect of the present invention. In other words, the addition of the additives of the present invention provides much more remarkable effects than the addition of carbon powder or a proper amount of oxygen.

In the present invention, when the amount of additives is less than 0.001 weight %, the residual carbon content is too small in the hot-working process, failing to provide the effects of improving both orientations of crystal grains and magnetic properties. On the other hand, when it exceeds 2 weight %, the magnetic properties of the hot-worked magnets are deteriorated. The preferred amount of the additives is 0.01–1.0 weight %.

The additives are most preferably in the form of liquid because they wet the overall surfaces of the magnetic powder particles. However, even powdery additives can be relatively uniformly mixed with the magnetic powder by selecting optimum mixing conditions. In addition, semi-fluid additives like grease can also be used with full attention.

The hot-worked magnets of the present invention are made of R-T-B alloys containing transition metals T as main components, rare earth elements R including yttrium and boron B. They contain magnetically anisotropic crystal grains having an average grain size of 0.02–1.0 μm. In the hot-worked magnets, the carbon content is 0.8 weight % or less, and the oxygen content is 0.5 weight % or less, but carbon and oxygen are concentrated in the boundaries between fine flaky particles constituting the magnets.

According to the present invention, by adding a proper amount of the above particular compounds as additives, the boundary structure which cannot be obtained simply by the addition of carbon is obtained. In the hot-worked magnets of the present invention, magnet powder particles are thin and uniformly flat when viewed perpendicular to the hot-working direction, so that they can be called "fine flaky particles". In the magnets, the fine flaky particles have boundaries clearly visible in the direction of hot working. On the other hand, in the hot-worked magnets produced without adding the organic compounds of the present invention, the boundaries are not clearly visible.

In the present invention, when the carbon content exceeds 0.8 weight %, the magnetic properties are deteriorated. Similarly, when the oxygen content exceeds 0.5 weight %, deformation resistance of the magnets being hot-worked extremely increases, lowering their workability. The preferred C content is 0.5 weight % or less, and the preferred O content is 0.3 weight % or less.

The magnetic alloys which may be used according to the present invention contain transition metals as main components and also rare earth elements including yttrium and boron B. Their compositions themselves may be substantially the same as those disclosed in European Patent Laid-Open No. EP 0,133,758. Incidentally, the transition metals in the present invention means iron as a main component, part of which is substituted by other transition metals including Co, Ni, Ru, Rh, Pd, Os, Ir, Pt and all other broadly defined transition metals of atomic numbers 21–29, 39–47, 72–79, 89 or more.

Ga is effective to remarkably increase the coercive force of the hot-worked magnets as previously reported by the inventors. Therefore, it may be added if necessary. Further, any additional elements may be added if necessary, depending upon applications without deviating from the objects of the present invention.

With respect to the rare earth elements R, it is based on Nd or Pr, and it may be partially substituted by Ce, didymium, etc. for reducing the costs of the magnets. Further, to improve the temperature characteristics of the magnets, the rare earth elements may be partially substituted by Dy, Tb, etc.

In the present invention, the crystal grains are extremely fine as a characteristic of the hot-worked magnets. Their average grain size is 0.02–1.0 μm. It is technically difficult to stably obtain as fine crystal grains as less than 0.02 μm. On the other hand, when the average grain size exceeds 1.0 μm, the coercive force of the resulting hot-worked magnets decreases.

Here, the average grain size is measured by an intercept method on electron photomicrograph. Specifically, an arbitrary straight line is drawn on an electron photomicrograph of a magnet sample to know how many crystal grains are covered by the straight line.

The crystal grain size is determined by dividing the length of the straight line by the number of crystal grains covered thereby, and at least 20 or more straight lines are drawn to measure the crystal grain sizes. The measured crystal grain sizes are finally averaged to determine the average crystal grain size.

It should be noted that in the hot-worked magnets, the crystal grains are in flat shapes in planes perpendicular to the C-axes. Accordingly when their cross sections parallel the C-axes are taken, thicknesses of flat flakes are measured. Thus, the above-described average grain size is defined as an average size in a plane perpendicular to the C-axes.

In the R-T-B permanent magnets of the present invention, magnet properties are derived from tetragonal crystals of R-T-B intermetallic compounds. These crystals have lattice constants of a=0.878 nm or so and c=1.218 nm or so at room temperature. In the hot-worked magnets, a peculiar phenomenon takes places, in which these crystal grains existing in mixture have C-axes aligned in parallel to the compression direction. This phenomenon is utilized in the present invention.

Therefore, the addition of the particular additives according to the present invention serves to remarkably improve the orientation of the crystal grains by lubricating actions, thereby providing the hot-worked magnets with good magnetic properties.

The orientations of the crystal grains can be measured by X-ray diffraction. The measured data are normalized by those of an isotropic sample. Specifically, first, X-ray diffraction intensity of each diffraction plane is measured by a diffractometer on an isotropic sample, and the sample machined from a hot-worked anisotropic magnet is measured with respect to X-ray diffraction intensity of each diffraction plane. The measured X-ray diffraction intensity of the anisotropic magnet sample is normalized by the intensity of the isotropic sample. Next, the normalized data were plotted relative to the angle of each diffraction plane to the C-plane, and utilizing a Gaussian distribution as an approximation method, the orientation of the crystal grains is expressed by a variance $\theta^2$ of the Gaussian distribution of the crystal grain orientation.

In the present invention, the angular variances of the crystal grain orientations from the C-axes are 30° or less on the magnet surface, which means that the crystal grains are highly oriented. In the conventional hot-worked magnets, the angular variances are more than 30°, meaning that sufficient orientation cannot be obtained, thereby failing to provide good magnetic properties. In addition, the difference between the maximum and minimum angular variances is desirably within the range of 10° or less.

The hot-worked magnets of the present invention are produced by plastic deformation at high temperature. As means for plastic deformation, extrusion, swaging, rolling, die-upsetting, etc. may be used. Particularly die-upsetting is effective for providing magnetic anisotropy to the magnets, because a stress distribution and a strain rate can be properly selected to provide excellent hot-worked magnets.

By the addition of the additives of the present invention, the magnets are uniformly deformed in the hot-working process. As a result, strain distribution in the magnets is uniform in the cross section thereof. On the contrary, int he conventional hot-worked magnets, the strain distribution is not uniform. As a result, cracks tend to appear so that the resulting hot-worked magnets cannot be used as final products without further working. Incidentally, strain distribution is measured by a X-ray stress measurement method, a hardness distribution measurement method, etc.

In the hot-worked magnets of the present invention, miroscopic observation shows that there are carbon, oxygen or carbides, oxides or other compounds derived from the additives in the boundaries between the fine flaky particles. However, the boundaries are extremely narrow as a characteristic of R-T-B hot-worked magnets, and since they are highly susceptible to oxidation and deterioration in the step of milling, the analysis of the boundaries is extremely difficult.

In addition, in the conventional hot-worked magnets, plastic deformation does not easily take place near the interface of a working die, reducing the orientation of the crystal grains, but in the hot-worked magnets of the present invention, plastic deformability is extremely improved, thereby providing good orientation of the crystal grains. Specifically, in the present invention, the angular variance of crystal grain orientations from the C-axes is 30° or less on the magnet surface measured by X-ray.

It should be noted that the present invention is effective not only on hot-worked magnets but also consolidated magnets produced simply by hot-pressing thin flakes, etc. produced by a rapid quenching.

The hot-worked magnets of the present invention can be pulverized to form magnetic powder which can be mixed with binders such as resins, low-melting point metals, etc. to produce bonded magnets.

The present invention will be explained in further detail by the following Examples.

EXAMPLE 1

An alloy having the composition of $Nd(Fe_{0.082}Co_{0.1}B_{0.07}Ga_{0.01})_{5.4}$ was produced by arc melting. This alloy was ejected into a single roll rotating at a surface velocity of 30 m/sec in an Ar atmosphere to produce irregularly shaped thin flakes of about 30 μm in thickness. As a result of X-ray diffraction measurement, it was found that the thin flakes were made of a mixture of amorphous phases and crystalline phases. The thin flakes were then pulverized to produce magnetic powder of 500 μm or less in size, and it was mixed with diethylene glycol (bivalent lower alcohol). Samples containing diethylene glycol in amounts of 0.5 weight % and 0.9 weight %, respectively, were pressed by a die under a pressure of 6 ton/cm$^2$ without applying a magnetic field to produce green bodies having a density of 5.7 g/cm$^3$, a diameter of 28 mm and a height of 47 mm.

Each of the resulting green bodies was hot-pressed at 740° C., 2 ton/cm$^2$ to produce a pressed body having a density of 7.4 g/cm$^3$, a diameter of 30 mm and a height of 30 mm. The pressed body was then subjected to die-upsetting at 740° C. and a compression ratio of 4 to provide it with magnetic anisotropy. Incidentally, the compression ratio means a value of the height of a sample before die-upsetting divided by the height after die-upsetting. In this Example, the height after die-upsetting was 7.5 mm. With respect to each of the magnetically anisotropic hot-worked magnets, optical photomicrographs (magnification: 100) were taken in parallel with the compression direction of the magnet.

Figure 2:
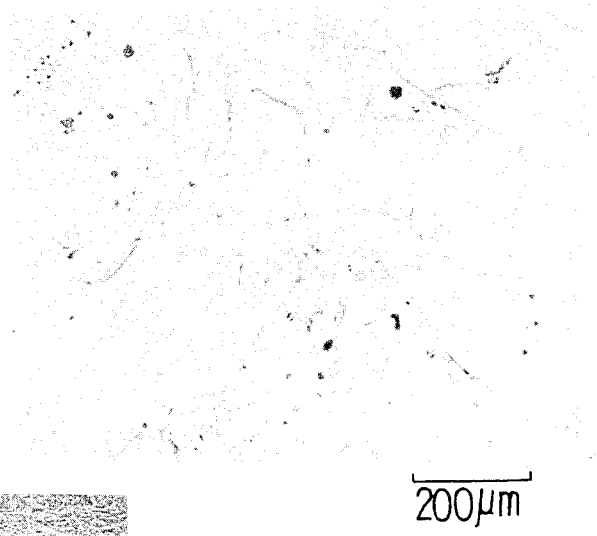
FIG. 2 is a photomicrograph (magnification: 100) of a hot-worked magnet produced by using 0.9 weight % of diethylene glycol, which is taken in parallel with the compression direction of the hot-worked magnet.

Both FIGS. 1 and 2 show the microstructures of the die-upset magnets in which fine planar flakes are seen.

It is clear from FIGS. 1 and 2 that the boundaries between fine flaky particles are clearly visible when the additives of the present invention are used.

EXAMPLE 2

Example 1 was repeated except for using various amounts (0–2.5 weight %) of ethylene glycol.

Figure 3:
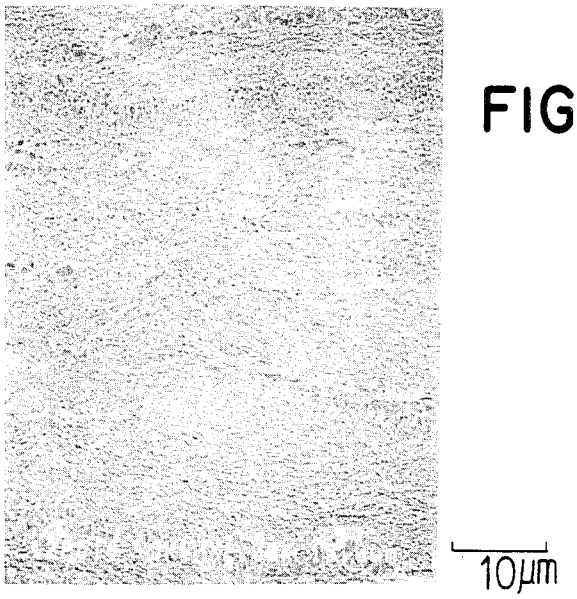
FIG. 3 is an electron micrograph (magnification: 2000) of a hot-worked magnet produced by using 0.7 weight % of ethylene glycol, which is taken in perpendicular to the compression direction of the hot-worked magnet.

With respect to each of the resulting magnetically anisotropic hot-worked magnets, photomicrograph was taken under the following conditions:

(1) 0.7 weight % ethylene glycol added (FIG. 3):
Magnification: 2000
Direction: Perpendicular to the compression direction.

Figure 5A:
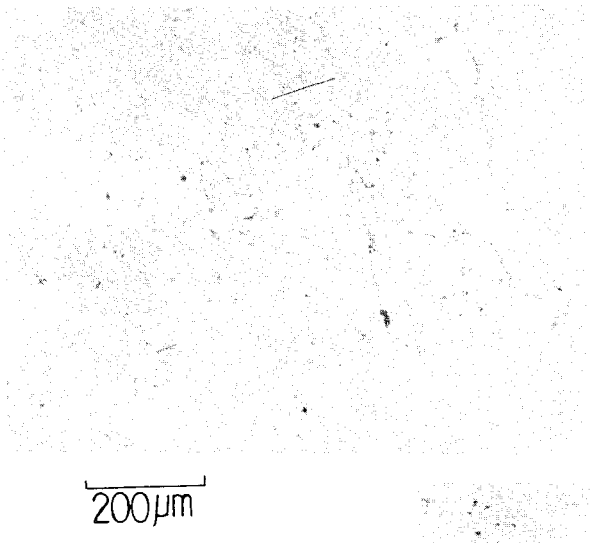
FIG. 5 A is a photomicrograph (magnification: 100) of a hot-worked magnet produced with no additive, which is taken in parallel with the compression direction of the hot-worked magnet.
Figure 5B:
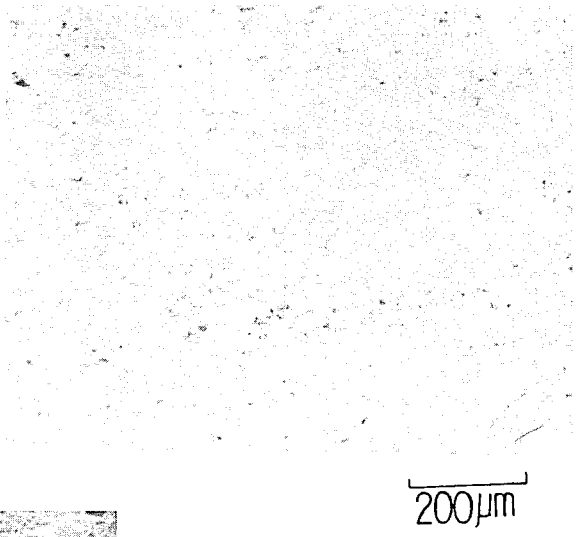

(2) No ethylene glycol added:
(a) FIGS. 5A and 5B
Magnification: 100
Direction: Parallel and perpendicular to the compression direction.
(b) FIG. 5C
Magnification: 2000
Direction: Perpendicular to the compression direction.

As is clear from the above results, the magnets produced by using the additives of the present invention have clearly visible boundaries between fine flaky particles.

Figure 4:
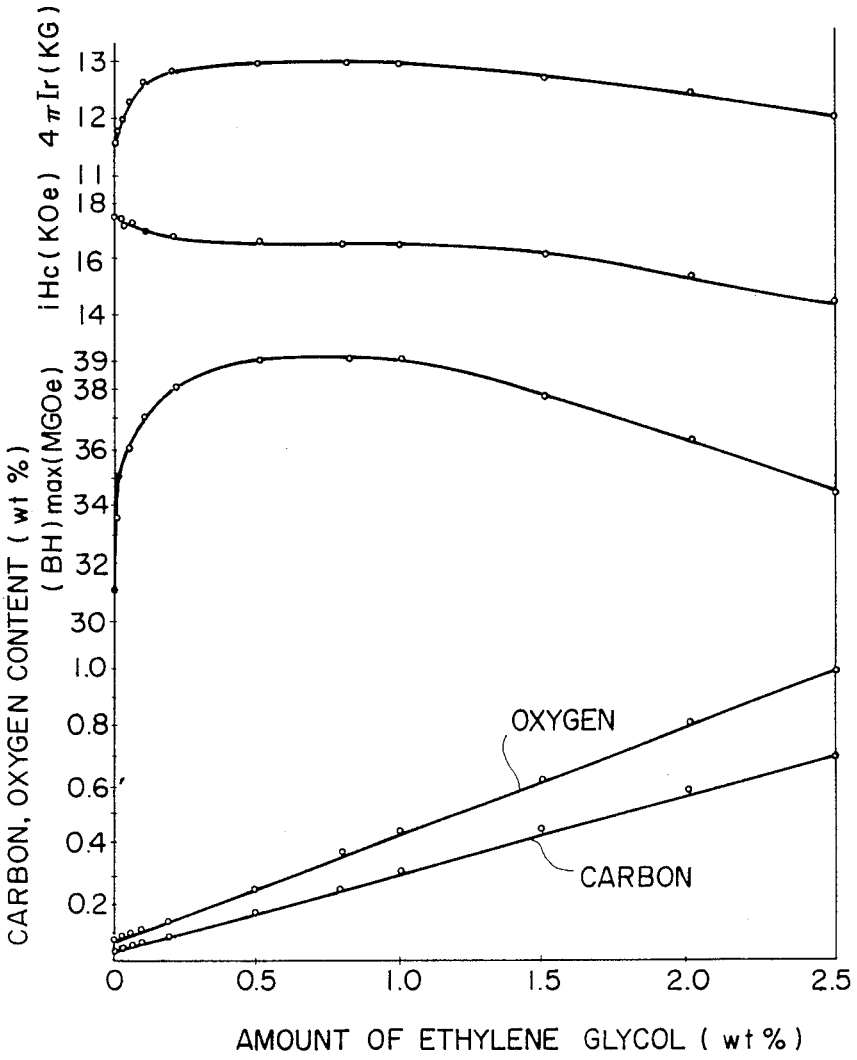
FIG. 4 is a graph showing the relations between the amount of ethylene glycol added and a carbon content, an oxygen content and magnetic properties.

Next, carbon and oxygen contents and magnetic properties were measured on each sample. FIG. 4 shows the residual carbon and oxygen concentrations and magnetic properties relative to the amount of ethylene glycol added.

It is clear from FIG. 4 that as the amount of ethylene glycol increases, the residual carbon and oxygen concentrations increase almost linearly, and that as compared with the addition of no ethylene glycol, the addition of even 0.001 weight % of ethylene glycol shows remarkable effects on the magnetic properties. Among the magnetic properties, particularly the $4\pi Ir$ is improved, and $(BH)_{mas}$ is improved by 8 MGOe as compared with the case of no additive.

When the amount of ethylene glycol was 3 weight %, the residual oxidation exceeded 10000 ppm (1 weight %), thereby deteriorating the workability of the magnets. As a result of forced die-upsetting process, many cracks were initiated on the edges of the magnets, and the magnetic properties were deteriorated.

EXAMPLE 3

In the same hot-working process as in EXAMPLE 1, the die-upsetting temperature was changed to 580° C., 600° C., 680° C., 740° C., 800° C., 850° C. and 870° C. stepwise, and at each temperature, the die-upsetting was conducted with various amounts of ethylene glycol. Table 1 shows the relations between deformation resistance (nominal compression stress) and strain. In Table 1, the "x" mark means that a magnet hot-worked at a compression ratio of up to 4 had more than 14 cracks in its peripheral portion. With respect to other samples, a nominal stress (ton/cm$^2$) at a strain of 0.3 (compression ratio = 1.43) is listed in Table 1. When the die-upsetting temperature was 580° C., all magnets suffered from many cracks, and some of them were bent. On the other hand, at 870° C., too, the stress increased extremely to produce many cracks. Accordingly, it is considered that the preferred hot-working temperature is between about 600° C., and about 850° C.

As a general tendency, the more ethylene glycol, the higher the optimum hot-working temperature. The range marked in Table 1 shows a range in which the hot-worked magnets produced at a compression ratio of up to 4 had as few cracks as 4 or less in the peripheral portions.

TABLE 1

| Sample No.(1) | Amount of Ethylene Glycol Added (weight %) | Hot Working Temperature (°C.) 580 | 600 | 680 | 740 | 800 | 850 | 870 |
|---|---|---|---|---|---|---|---|---|
| 1 | 0 | x | x | 1.12 | 1.05 | x | x | x |
| 2 | 0.001 | x | 1.23 | 1.20 | 1.07 | 1.03 | 1.20 | x |
| 3 | 0.01 | x | 1.25 | 1.23 | 1.07 | 1.03 | 1.23 | x |
| 4 | 0.05 | x | 1.37 | 1.34 | 1.04 | 0.97 | 1.35 | x |
| 5 | 0.2 | x | 1.44 | 1.42 | 0.98 | 0.94 | 1.50 | x |
| 6 | 0.8 | x | x | x | 0.99 | 0.89 | 1.55 | x |
| 7 | 1.5 | x | x | x | 1.12 | 0.96 | x | x |
| 8 | 2.0 | x | x | x | x | 0.98 | x | x |
| 9 | 3.0 | x | x | x | x | x | x | x |

Note(1):
Sample Nos. 1 and 9: Outside the present invention.
Sample Nos. 2–8: Present invention.

EXAMPLE 4

Example 2 was repeated except for using as an additive oleic acid belonging to unsaturated aliphatic acid. The same measurements were conducted, and the results are shown in Table 2. Both of the residual carbon content and the residual oxygen concentration increased linearly as in the case of ethylene glycol. However, the residual carbon content was slightly larger for oleic acid than for ethylene glycol, and the oxygen concentration showed opposite tendency. With respect to magnetic properties, they showed substantially the same tendency relative to the residual carbon content as in the case of adding ethylene glycol. In addition, the workability of the magnets was also improved.

TABLE 2

| Sample No.(1) | Amount of Oleic Acid Added (weight %) | Residual Carbon Content (weight %) | Residual Oxygen Content (ppm) | $4\pi Ir$ (G) | iHc (Oe) | $(BH)_{max}$ (MGOe) |
|---|---|---|---|---|---|---|
| 1 | 0 | 0.018 | 680 | 11600 | 17300 | 31.0 |
| 2 | 0.001 | 0.031 | 688 | 12000 | 17100 | 33.0 |
| 3 | 0.005 | 0.034 | 688 | 12100 | 17100 | 33.0 |
| 4 | 0.01 | 0.037 | 701 | 12200 | 17100 | 34.0 |
| 5 | 0.02 | 0.045 | 719 | 12400 | 17000 | 36.0 |
| 6 | 0.05 | 0.060 | 766 | 12700 | 16800 | 37.0 |
| 7 | 0.1 | 0.091 | 851 | 12800 | 16600 | 38.0 |
| 8 | 0.2 | 0.153 | 1036 | 12900 | 16500 | 39.0 |
| 9 | 0.5 | 0.327 | 1524 | 13000 | 16400 | 40.0 |
| 10 | 0.8 | 0.502 | 2075 | 12900 | 16000 | 39.0 |
| 11 | 1.0 | 0.539 | 2395 | 12500 | 15300 | 36.0 |
| 12 | 1.5 | 0.584 | 3273 | 12300 | 15300 | 34.0 |

TABLE 2-continued

| Sample No.(1) | Amount of Oleic Acid Added (weight %) | Residual Carbon Content (weight %) | Residual Oxygen Content (ppm) | 4 πIr (G) | iHc (Oe) | $(BH)_{max}$ (MGOe) |
|---|---|---|---|---|---|---|
| 13 | 2.0 | 0.59 | 4200 | 12000 | 14500 | 32.0 |
| 14 | 3.0 | 0.856 | 5822 | 11000 | 9400 | 26.0 |

Note(1):
Sample Nos. 1 and 14: Outside the present invention.
Sample Nos. 2-13: Present invention.

EXAMPLE 5

Example 3 was repeated by using oleic acid in an amount of 0.1 weight %, 0.3 weight % and 0.5 weight %, respectively, to take optical and electron photomicrographs of the resulting magnets in perpendicular to their compression directions.

Figure 6A:
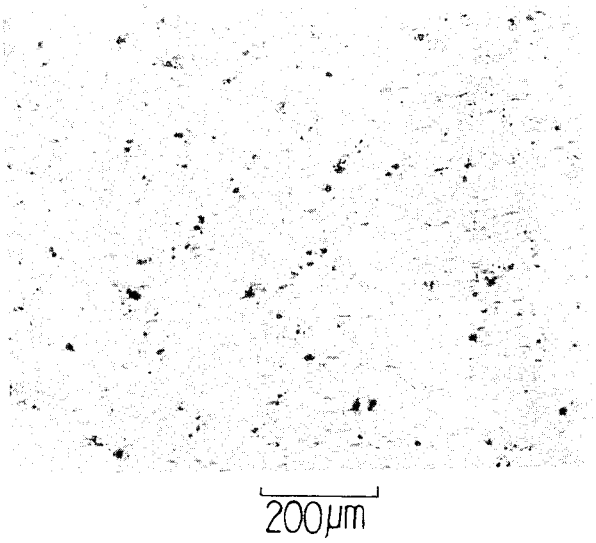
FIG. 6 A is a photomicrograph (magnification: 100) of a hot-worked magnet produced by using 0.1 weight % of oleic acid, which is taken in perpendicular to the compression direction of the hot-worked magnet.
Figure 6B:
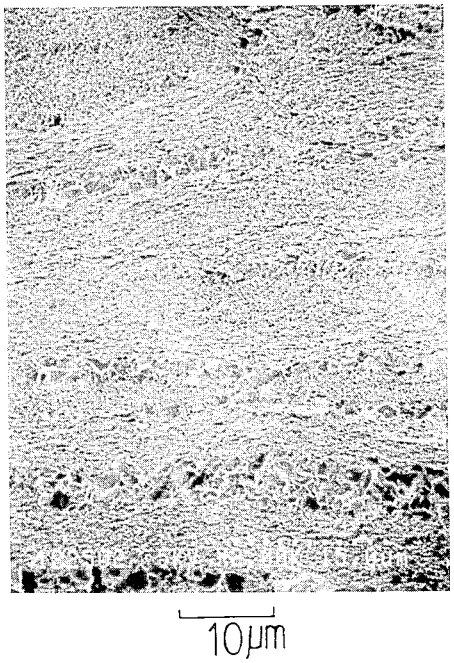
Figure 7A:
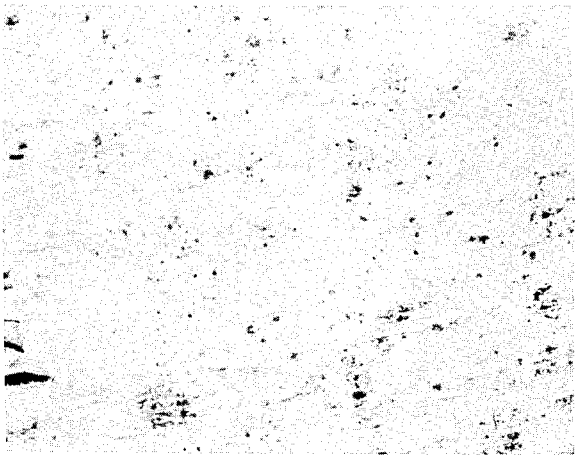
FIG. 7 A is a photomicrograph (magnification: 100) of a hot-worked magnet produced by using 0.3 weight % of oleic acid, which is taken in perpendicular to the compression direction of the hot-worked magnet.
Figure 7B:
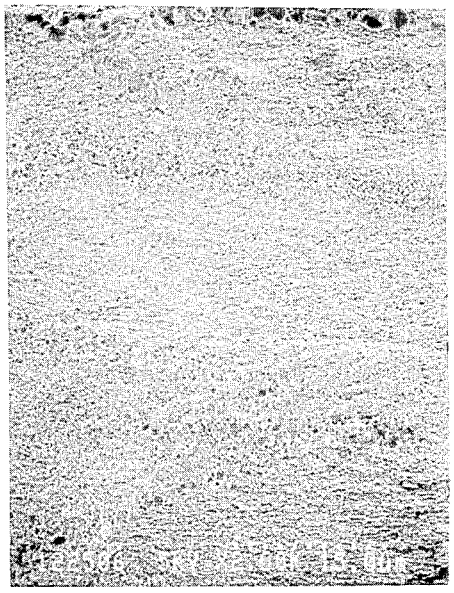
Figure 8A:
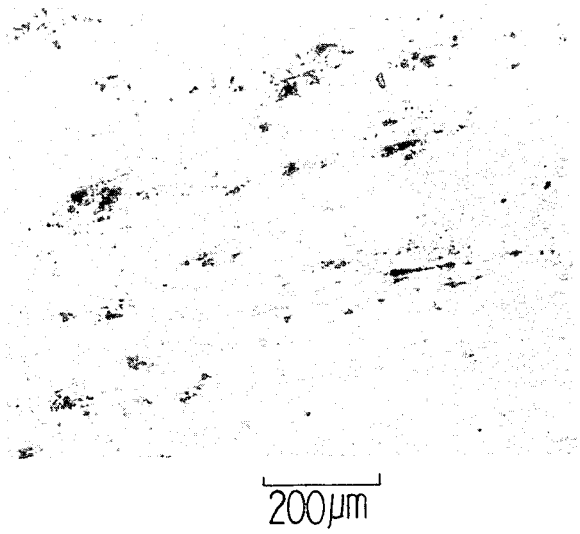
FIG. 8 A is a photomicrograph (magnification: 100) of a hot-worked magnet produced by using 0.5 weight % of oleic acid, which is taken in perpendicular to the compression direction of the hot-worked magnet.
Figure 8B:
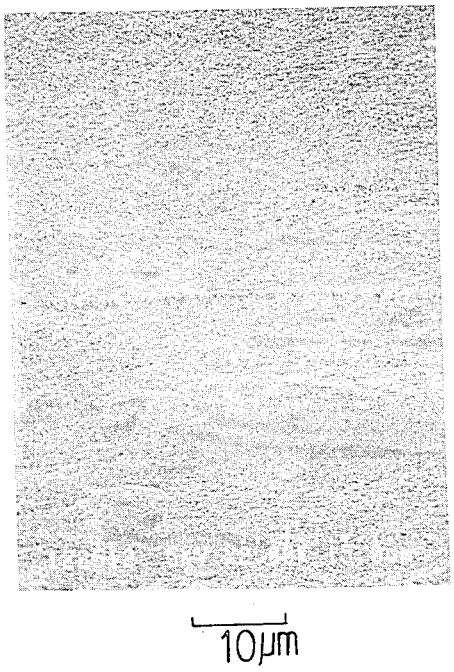

FIGS. 6A, 7A and 8A are at magnification of 100, and FIGS. 6B, 7B and 8B are at magnification of 2,000.

Figure 5C:
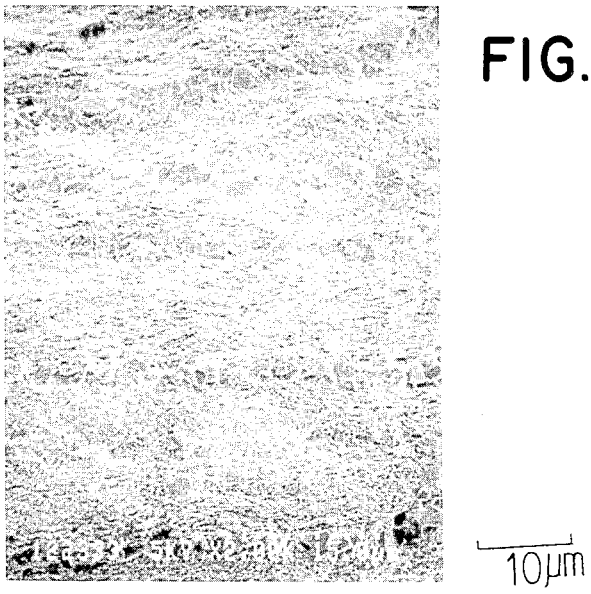

As is clear from FIGS. 6-8, crystal phases in the boundaries between the adjacent fine flaky particles in the die-upset magnets are finer when olefin acid is added as an additive than when no additive is added (FIG. 5C)

EXAMPLE 6 an alloy having the composition of $Nd(Fe_{0.83}Co_{0.09}B_{0.07}Ga_{0.01})_{5.7}$ was produced by arc melting. This alloy was ejected into a single roll rotating at a surface velocity of 30 m/sec in an Ar atmosphere to produce thin flakes of about 30 μm in thickness.

Next, the thin flakes were pulverized to produce magnetic powder of 500 μm or less, and it was mixed with ethylene glycol. Samples containing no ethylene glycol and 0.5 weight % of ethylene glycol were pressed by a die under a pressure of 6 ton/cm$^2$ without applying a magnetic field to produce green bodies having a density of 5.7 g/cm$^3$, a diameter of 28 mm and a height of 47 mm.

Each of the resulting green bodies was hot-pressed at 720° C., 2 ton/cm$^2$ to produce a pressed body. The pressed body was then subjected to die-upsetting at a compression ratio of 4 to provide it with magnetic anisotropy.

Figure 9:
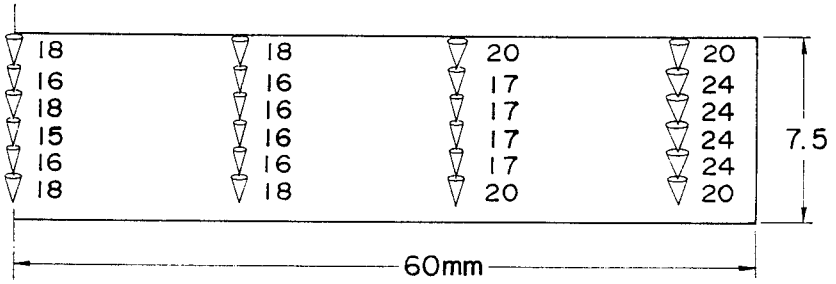
FIG. 9 is a schematic view showing the distribution of the crystal grain orientations in the vertical cross section of the hot-worked magnet of the present invention.

Crystal grain orientation was measured by X-ray on samples machined from various portions of the resulting magnetically anisotropic hot-worked magnets to know the angular variances of the crystal grain orientations from the C-axes of the crystal grains, both in a depth direction and in a planar direction. The magnetic properties of the magnets were also measured. The magnetic properties are shown in Table 3, and the crystal grain orientations are shown in FIG. 9 for the magnet of the present invention, and in FIG. 10 for the magnet outside the present invention. Both FIGS. 9 and 10 show cross sections taken along a plane including the die-upsetting direction.

Figure 10:
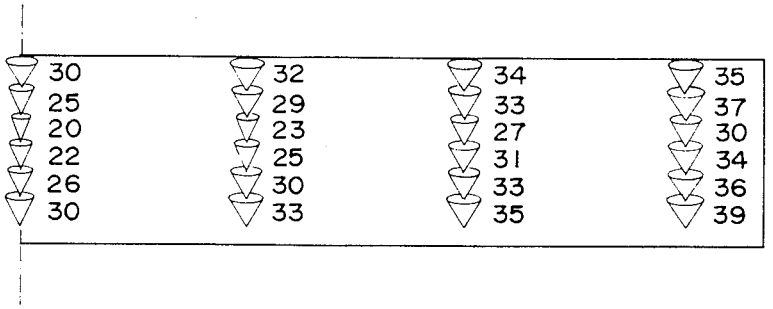
FIG. 10 is a schematic view showing the distribution of the crystal grain orientations in the cross vertical section of the hot-worked magnet of the reference.

In FIGS. 9 and 10, each cone schematically shows the angular variances of the crystal grain orientations, and number described by each cone shows the value of the angular variance. The smaller this value, the higher the orientation of the crystal grain.

As is clear from Table 3 and FIGS. 9 and 10, the addition of ethylene glycol dramatically improves the flowability of the magnets in the process of plastic deformation, thereby improving the crystal grain orientation and thus magnetic properties.

TABLE 3

| Magnet | 4 πIr (kG) | iHc (kOe) | bHc (kOe) | $(BH)_{max}$ (MGOe) |
|---|---|---|---|---|
| 0.5 weight % EG* Added | 12.8 | 16.0 | 12.0 | 39.5 |
| No EG Added | 11.6 | 17.3 | 10.5 | 31.0 |

Note EG*:
Ethylene Glycol.

EXAMPLE 7

0.5 weight % of various hydrocarbon compounds are added in the same manner as in Example 1, and $(BH)_{max}$ of each sample is measured. The results are shown in Table 4. It is clear from Table 4 that the magnetic properties are also improved by these additives. Incidentally, in all cases, the residual carbon content is 0.6 weight % or less, and the residual oxygen concentration is 0.5 weight % or less, causing few cracks.

TABLE 4

| Sample No. | Type of Additive | $(BH)_{max}$ (MGOe) |
|---|---|---|
| 1 | Butyl Alcohol | 39.7 |
| 2 | Amyl Alcohol | 39.6 |
| 3 | Hexyl Alcohol | 39.8 |
| 4 | Octyl Alcohol | 39.7 |
| 5 | Propyl Alcohol | 39.9 |
| 6 | Triethylene Glycol | 39.6 |
| 7 | Propylene Glycol | 39.9 |
| 8 | Trimethylene Glycol | 39.7 |
| 9 | Tetramethylene Glycol | 39.7 |
| 10 | Glycerin | 39.7 |
| 11 | Trimethyl Propanol | 39.8 |
| 12 | Diglycerin | 39.7 |
| 13 | Triglycerin | 39.6 |
| 14 | Propionic Acid | 39.7 |
| 15 | Lauric Acid | 39.8 |
| 16 | Stearic Acid | 39.5 |
| 17 | Palmitic Acid | 39.8 |
| 18 | Acrylic Acid | 39.7 |
| 19 | Linoleic Acid | 39.7 |
| 20 | Benzoic Acid | 39.8 |
| 21 | Oxalic Acid | 39.8 |
| 22 | Methyl Propyl Ketone | 39.6 |
| 23 | Cyclopentanone | 39.5 |
| 24 | Benzophenone | 39.7 |
| 25 | Diphenylketene | 39.7 |
| 26 | Diethylketene | 39.5 |
| 27 | Acrolein | 39.7 |
| 28 | Propionaldehyde | 39.6 |
| 29 | Caprylaldehyde | 39.5 |
| 30 | Propyl Ether | 39.7 |
| 31 | Methyl Amyl Ether | 39.5 |
| 32 | Allyl Ether | 39.7 |
| 33 | Phenyl Ether | 39.8 |

According to the present invention, the addition of organic compound additives dramatically improves the workability of R-T-B magnets in the process of hot working, and the resulting hot-worked magnets are provided with magnetic properties remarkably improved to such an extent that the conventional techniques fail to achieve.

What is claimed is:

1. A method of producing a magnetically anisotropic hot-worked magnet comprising the steps of: rapidly quenching a melt of an R-T-B alloy containing a transition metal T as a main component, a rare earth element R including yttrium, and boron B, to form thin ribbons or flakes; pulverizing said thin ribbons or flakes to form magnetic powder; and subjecting said magnetic powder to hot working to provide the resulting magnet with magnetic anisotropy, where the method includes the further step of mixing said magnetic powder with an additive composed of at least one organic compound having a boiling point of 150° C. or higher before said subjecting step.

2. The method according to claim 1, wherein said additive is at least one monovalent- or multivalent-alcohol or a derivative thereof.

3. The method according to claim 1, wherein said additive is at least one carboxylic acid or a derivative thereof.

4. The method according to claim 1, wherein said additive is at least one oxo compound or a derivative thereof.

5. The method according to claim 1, wherein said additive is at least one ester or a derivative thereof.

6. The method according to claim 1, wherein said additive is at least one ether or a derivative thereof.

7. The method according to claim 1, wherein said additive is selected from the group consisting of diethylene glycol, ethylene glycol and oleic acid.

8. The method according to claim 1 wherein said mixing step comprises mixing said magnetic powder with about 0.001–2.0 weight % of the additive.

9. The method according to claim 1 wherein said mixing step comprises mixing said magnetic powder with about 0.1–1.0 weight % of the additive.

* * * * *

UNITED STATES PATENT AND TRADEMARK OFFICE

CERTIFICATE OF CORRECTION

PATENT NO. : 4,978,398

DATED : December 18, 1990

INVENTOR(S) : Katsunori Iwasaki et al

It is certified that error appears in the above-identified patent and that said Letters Patent is hereby corrected as shown below:

On the title page, in the Abstract, line 6, change "than" to --and--.

Claim 1, column 13, line 12, change "where" to --wherein--.

Claim 9, column 14, line 19, change "0.1-1.0" to --0.01-1.0--.

Signed and Sealed this

Seventh Day of April, 1992

*Attest:*

HARRY F. MANBECK, JR.

*Attesting Officer*

*Commissioner of Patents and Trademarks*